US011111761B1

(12) United States Patent
Gowanlock

(10) Patent No.: US 11,111,761 B1
(45) Date of Patent: Sep. 7, 2021

(54) DRILLING RIG WITH ATTACHED LIGHTING SYSTEM AND METHOD

(71) Applicant: APOLLO ENERGY SERVICES CORP., Calgary (CA)

(72) Inventor: Matthew Gowanlock, Airdrie (CA)

(73) Assignee: APOLLO ENERGY SERVICES CORP., Calgary (CA)

( * ) Notice: Subject to any disclaimer, the term of this patent is extended or adjusted under 35 U.S.C. 154(b) by 0 days.

(21) Appl. No.: 16/325,055

(22) PCT Filed: Aug. 30, 2017

(86) PCT No.: PCT/IB2017/055218

§ 371 (c)(1),
(2) Date: Feb. 12, 2019

(87) PCT Pub. No.: WO2018/042348

PCT Pub. Date: Mar. 8, 2018

Related U.S. Application Data

(60) Provisional application No. 62/381,941, filed on Aug. 31, 2016.

(51) Int. Cl.

| | |
|---|---|
| ***F21V 21/30*** | (2006.01) |
| ***E21B 41/00*** | (2006.01) |
| ***E21B 15/00*** | (2006.01) |
| *F21W 131/10* | (2006.01) |

(52) U.S. Cl.
CPC ..... *E21B 41/00* (2013.01); *E21B 15/00* (2013.01); *F21V 21/30* (2013.01); *F21W 2131/1005* (2013.01)

(58) Field of Classification Search
CPC ..... F21V 21/30; E21B 41/00; E21B 15/00; F21W 2131/1005
See application file for complete search history.

(56) References Cited

U.S. PATENT DOCUMENTS

| | | | |
|---|---|---|---|
| 2,763,466 | A | 9/1956 | Lehr |
| 2,895,039 | A | 7/1959 | Hutchison |
| 3,696,241 | A | 10/1972 | Meyer |
| 3,856,639 | A | 12/1974 | Rohn |

(Continued)

FOREIGN PATENT DOCUMENTS

| | | |
|---|---|---|
| CA | 2928251 | 6/2015 |
| CN | 201232899 | 5/2009 |

(Continued)

OTHER PUBLICATIONS

PCT Search Report and forms issued in PCT/IB2017/055218.

(Continued)

*Primary Examiner* — Anne M Hines
(74) *Attorney, Agent, or Firm* — Greenblum & Bernstein, P.L.C.

(57) ABSTRACT

An attachable lighting system for a drilling rig. A method of providing lighting to a drilling rig site comprising, attaching at least one light fixture directly to the crown of a drilling rig on each of at least two sides, wherein the light fixture contains a fixed or removable light fixture attachment connecting the light fixture to the crown, resulting in one or more of enhanced evenness of site lighting, reduced shadows, reduced light pollution, reduced power consumption and/or reduced diesel usage.

20 Claims, 3 Drawing Sheets

(56) References Cited

U.S. PATENT DOCUMENTS

| | | | | |
|---|---|---|---|---|
| 4,903,442 | A | 2/1990 | Trommen | |
| 4,937,717 | A | 6/1990 | Betzvog, Jr. | |
| 5,272,611 | A | 12/1993 | Lai | |
| 6,155,696 | A | 12/2000 | Winton | |
| 6,848,806 | B2 | 2/2005 | Yoshida | |
| 8,814,221 | B2 | 8/2014 | Grant | |
| 9,316,390 | B2 | 4/2016 | Gowanlock | |
| D757,343 | S | 5/2016 | Dupuis et al. | |
| 9,534,626 | B2 | 1/2017 | Walton et al. | |
| 9,945,143 | B2 | 4/2018 | Pannekoek et al. | |
| 10,125,935 | B2 | 11/2018 | Gowanlock et al. | |
| 10,145,544 | B2 | 12/2018 | Gowanlock et al. | |
| 10,392,826 | B2 | 8/2019 | Pannekoek et al. | |
| 10,473,282 | B2 | 11/2019 | Allison et al. | |
| 10,473,310 | B2 | 11/2019 | Carroll | |
| 10,598,359 | B2 | 3/2020 | Pannekoek et al. | |
| 10,976,016 | B2 | 4/2021 | Allison et al. | |
| 2005/0184207 | A1 | 8/2005 | Bertram, III | |
| 2006/0176708 | A1 | 8/2006 | Gordin | |
| 2012/0217897 | A1 | 8/2012 | Gordin et al. | |
| 2013/0135848 | A1 | 5/2013 | Chrysanthous | |
| 2015/0153036 | A1* | 6/2015 | Gowanlock ..... | F21V 33/00 362/249.01 |
| 2015/0184840 | A1 | 7/2015 | Gowanlock et al. | |
| 2016/0109079 | A1 | 4/2016 | McKinley et al. | |
| 2017/0023195 | A1 | 1/2017 | Gowanlock et al. | |
| 2018/0010748 | A1 | 1/2018 | Gowanlock | |
| 2018/0163956 | A1 | 6/2018 | Gowanlock | |
| 2018/0187873 | A1 | 7/2018 | Carroll | |
| 2019/0242218 | A1 | 8/2019 | Gowanlock | |
| 2020/0072451 | A1 | 3/2020 | Carroll | |

FOREIGN PATENT DOCUMENTS

| | | |
|---|---|---|
| CN | 101608765 | 12/2009 |
| CN | 203214012 | 9/2013 |
| CN | 203215413 | 9/2013 |
| CN | 203336518 | 12/2013 |
| CN | 203442735 | 2/2014 |
| CN | 103629549 | 3/2014 |
| CN | 104763930 | 7/2015 |
| CN | 204460120 | 7/2015 |
| CN | 204754882 | 11/2015 |
| CN | 103836575 | 5/2016 |
| CN | 108240588 | 7/2018 |
| DE | 3806241 | 9/1989 |
| KR | 10-1612883 | 4/2016 |
| WO | 2018/020400 | 2/2018 |
| WO | 2019/191843 | 10/2019 |

OTHER PUBLICATIONS

Swivelpole Brochure; Swivelpole Product Catalogue NEC V2-4, printed Mar. 2014, pp. 5-9, advanteklighting.ca/wp-content/uploads/2013/07/Swivelpole-North-American-Catalogue.

"Light Mounting Systems—LMS113—Handrail Mount Spigot Pole (UBOLT)." Uploaded by: Light Mounting Systems Australia, YouTube, Jul. 28, 2015, www.youtube.com/watch?v=FYdd50ZsUPM.

"Light Mounting Systems—LMS013, LMS113, LMS012, LMS112—Standard Handrail Mount Spigot Poles." YouTube, Jul. 29, 2015, www.youtube.com/watch?v=QqZj2RkqdKU.

"Light Mounting: Lighting Pole: Handrail Stanchion LMS 113—IndustrySearch Australia" www.industrysearch.com.au/light-mounting-lighting-pole-handrail-stanchion-lms-113/p/149012, retrieved Jul. 6, 2021.

"Light Mounting: Lighting Pole: Handrail Stanchion LMS013—IndustrySearch Australia" www.industrysearch.com.au/light-mounting-lighting-pole-handrail-stanchion-lms013/p/149010, retrieved Jul. 6, 2021.

"Light Mounting: Lighting Poles: Floodlight LMS075—IndustrySearch Australia" www.industrysearch.com.au/light-mounting-lighting-poles-floodlight-lms075/p/149019, retrieved Jul. 6, 2021.

"Choose a Swivelpole™—S-Series" + "Choose a Swivelpole™—H-Series" Swivelpole, swivelpole.com/au/products, retrieved Jul. 6, 2021.

* cited by examiner

DRILLING RIG WITH ATTACHED LIGHTING SYSTEM AND METHOD

CROSS-REFERENCE TO RELATED APPLICATIONS

This international application claims the benefit of U.S. Provisional Application Ser. No. 62/381,941, filed Aug. 31, 2016 which may relate to subject matter disclosed in one or more of U.S. Application Ser. No. 62/366,377, filed Jul. 25, 2016; Ser. No. 62/196,556, filed Jul. 24, 2015; Ser. No. 14/093,097, filed Nov. 29, 2013; Ser. No. 14/632,592, filed Feb. 26, 2015; Ser. No. 62/109,966, filed Jan. 30, 2015; and Ser. No. 62/127,020, filed Mar. 2, 2015. The entirety of each of the aforementioned applications is specifically incorporated herein by reference for all purposes.

FIELD OF THE INVENTION

The present invention relates generally to the field of drilling apparatuses, such as oil drilling rig arrangements, and in particular to a lighting system for use on a drilling rig.

BACKGROUND OF THE INVENTION

Drilling rigs are used to form wellbores for the purpose of extracting oil, natural gas or other fluids from subsurface deposits. Drilling rigs can also be used for sampling subsurface mineral deposits, testing rock or ground fluid properties and for installing subsurface utilities, instrumentations, tunnels or wells. In implementation, drilling rigs may be mobile equipment transportable by truck, rail, trailers, or similar, rigs may also be semi-permanent and permanent fixtures as in the case for oil drilling of large wells. Marine-based structures are also widely known. Generally, the term drilling rig refers to an arrangement of equipment that is used to penetrate the subsurface of the earth's crust.

Drilling operations typically occur during daylight hours and visibility in and around the drilling rig has historically only been required when manual work is being done, inspection and calibration, for example. There is a desire to increase productivity by providing visibility during hours of low daylight, and this has thus far been accomplished by providing mobile lighting arrangements on vehicles proximate the drilling rig, or otherwise manually adding or providing impromptu lighting arrangements.

These arrangements are inadequate and not readily adaptable to systematic visibility improvements in appropriate locations around a drilling rig.

SUMMARY OF THE INVENTION

A method of providing lighting to a drilling rig site is described herein including attaching at least one light fixture directly to the crown of a drilling rig on each of at least two sides of the crown, where the light fixture contains a fixed or removable light fixture attachment connecting the at least one light fixture to the crown, resulting in one or more of enhanced evenness of site lighting, reduced site shadows, reduced site light pollution, reduced site power consumption and/or reduced site diesel usage.

Additional embodiments described herein include: the method described above where the light fixture and light fixture attachment are a single piece; the method described above where the light fixture is fixed or adjustable; the method described above where the light fixtures are attached around the perimeter of the crown; the method described above where the light fixtures are attached to all sides of the crown; the method described above where more than one light fixture is attached to each side of the crown; the method described above where said each light fixture attachment holds one or more light fixture spaced vertically or horizontally from each other; the method described above where each lighting fixture can swivel and/or tilt; the method described above additionally including secondary containment; the method described above where the crown forms a generally rectangular shape; and the method described above where the lighting is provided to 180 degrees to 360 degrees around the drilling site.

A drilling rig is also described including a derrick or mast and crown, having a drilling site lighting system attached thereto, comprising at least one light fixture attached directly to the crown on each of at least two sides, wherein the light fixture contains a fixed or removable light fixture attachment connecting the light fixture to the crown, resulting in one or more of enhanced evenness of site lighting, reduced site shadows, reduced site light pollution, reduced site power consumption and/or reduced site diesel usage.

Additional embodiments described herein include: the drilling rig described above where the light fixture and light fixture attachment are a single piece; the drilling rig described above where the light fixture is fixed or adjustable; the drilling rig described above where the light fixtures are attached around the perimeter of the crown; the drilling rig described above where the light fixtures are attached to all sides of the crown; the drilling rig described above where more than one light fixture is attached to each side of the crown; the drilling rig described above where said each light fixture attachment holds more than one light fixture spaced vertically or horizontally from each other; the drilling rig described above where each lighting fixture can swivel and/or tilt; the drilling rig described above additionally including secondary containment; the drilling rig described above where the crown forms a generally rectangular shape; and the drilling rig described above where the lighting is provided to 180 degrees to 360 degrees around the drilling site.

These and additional embodiments are further described below.

BRIEF DESCRIPTION OF THE DRAWINGS

Embodiments will now be described, by way of example only, with reference to the attached Figures, wherein.

DETAILED DESCRIPTION

Figure 1A:
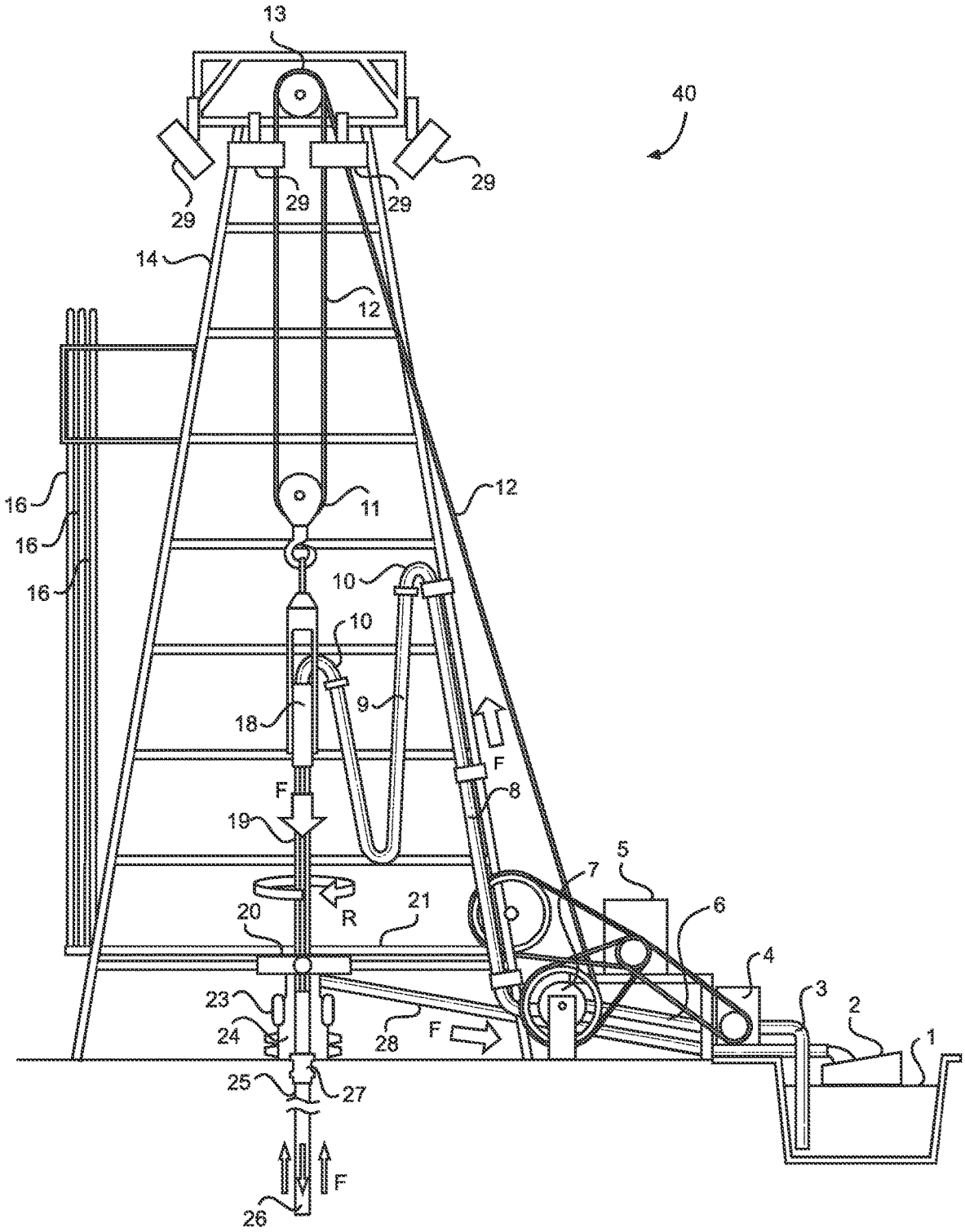
FIG. 1A is a lighting system mounted on a drilling rig as described herein.

An embodiment of a conventional drilling rig 40 with the light fixtures described herein is illustrated in FIG. 1A, where the drilling rig 40 includes a derrick 14, which provides a support structure for a majority of the equipment used to raise and lower drillstring 25 into and out of a wellbore. The drillstring 25 may be an assembled collection of drillpipe, drill collars, or any other assembled collection of assorted tools and equipment connected together and run into the wellbore to facilitate the drilling of a well. The drillstring 25 may be raised and lowered into and out of the wellbore by the draw-works 7, which includes a spool powered by a motor or other power source 5. A drill line 12, which may be a thick, stranded metal cable, is run through a travelling block 11. Typically, the crown block 13 remains stationary while travelling block 11 moves vertically with the drillstring 25. The combination of the crown block 13 and the travelling block 11 provides a significant mechanical advantage for lifting the drillstring 25. Further, a swivel 18 may be attached to the travelling block 11 to allow rotation of the drillstring 25 without twisting the travelling block 11. Drill pipes 16 and hole casing 26 are also shown.

The drilling rig 40 further includes a rotary table 20 mounted in a rig floor 21, which is used to rotate the drillstring 25 along with a kelly drive 19. Kelly drive 19, attached at an upper end to the swivel 18 and at a lower end to the drillstring 25, is inserted through the rotary table 20 to rotate the drillstring 25 (drillstring rotation shown by arrow "R"). Kelly drive 19 may be square, hexagonal, or any other polygonal-shaped tubing and is able to move freely vertically while the rotary table 20 rotates it. Alternatively, drilling rig 30 may include a top drive (not shown) in place of kelly drive 19 and rotary table 20. Additionally, blowout preventers ("BOPs") may be located below the rig floor 21 and installed atop a wellhead 27 to prevent fluids and gases from escaping from the wellbore. An annular BOP 23 and one or more ram BOPs 24 are shown and are commonly understood in the art.

During drilling operations, drilling fluid may be circulated through the system to carry cuttings away from the bottom of the wellbore as drilling progresses. Drilling fluid may be stored in mud tanks 1 before being drawn through suction line 3 by mud pumps 4. Drilling fluid (drilling fluid route is indicated by arrows "F") is then pumped from mud pumps 4 through a hose 6, up a stand pipe 8, through a flexible hose 9, and down into the wellbore. Drilling fluid returning from the wellbore is routed through a flow line 28 to shakers 2, which are used to separate drill cuttings from the drilling fluid before it is pumped back down the wellbore.

Figure 1B:
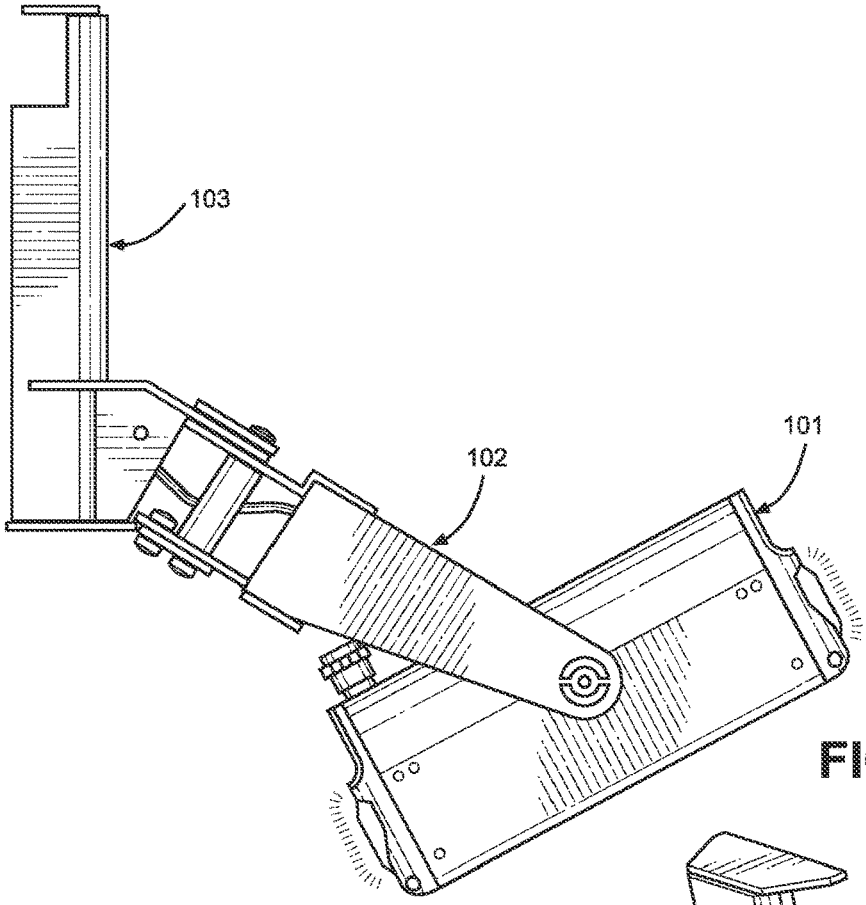
FIG. 1B is a side view of one embodiment of a light fixture as described herein.
Figure 2:
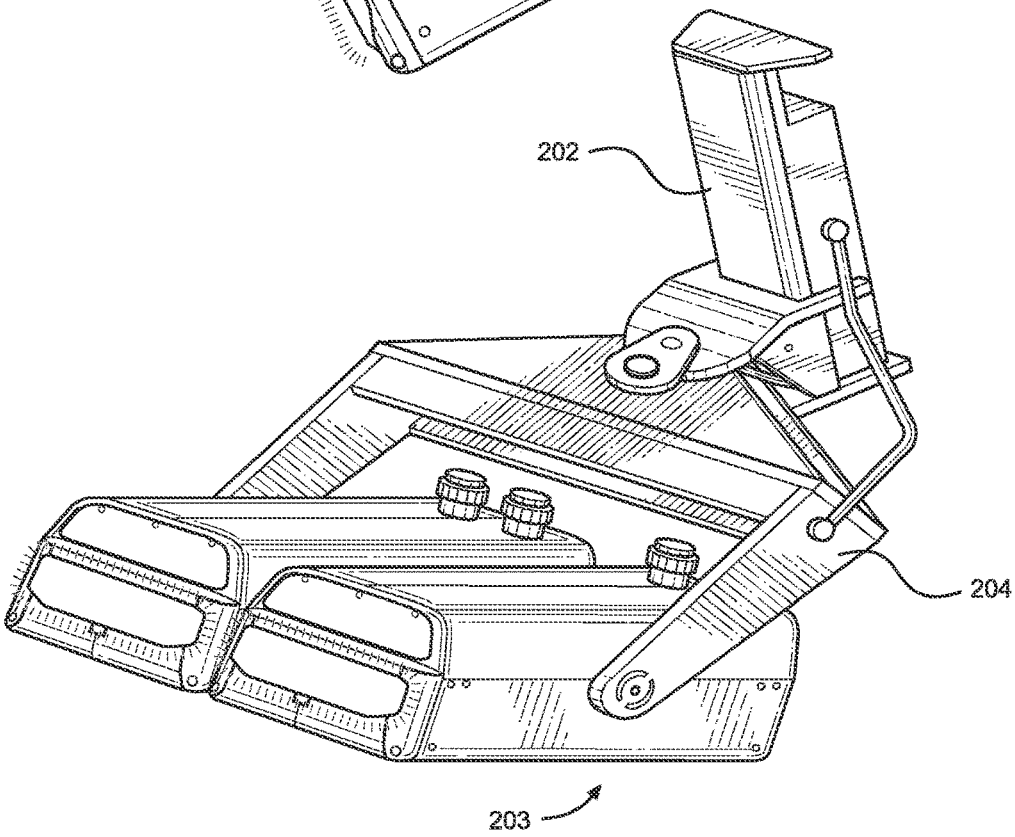
FIG. 2 is a perspective view of one embodiment of a light fixture as described herein.

The light fixtures described herein (29) are shown attached directly to the crown, in this instance visible on three sides. The light fixture (101 and 203) as shown in this embodiment also in FIG. 1B and in perspective view in FIG. 2 is held by a bracket (102 and 204) which permits the light fixture to swivel both in a horizontal and vertical orientation. And in this embodiment, the light fixture is connected to the crown directly through the light fixture attachment (103 and 202). The light fixtures can be commercially purchased or custom designed with commercially available materials to suit the use and situation, including specific materials of use (e.g., carbon steel or aluminum, etc.) and light power needs or desired.

Figure 3:
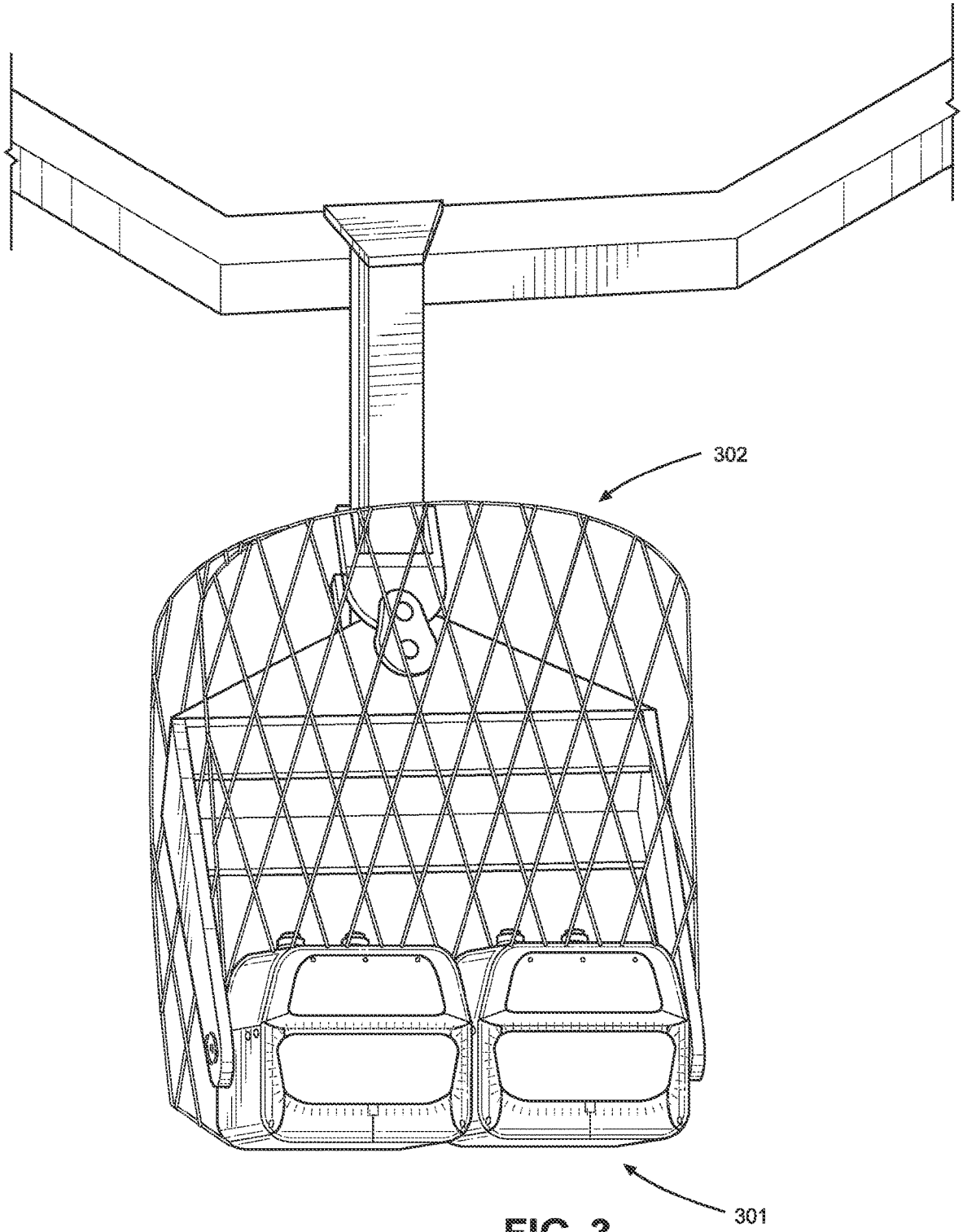
FIG. 3 is a perspective view showing an embodiment of secondary containment as described herein.

It should also be noted that the entire unit can also be built with secondary containment on all the equipment as demonstrated in FIG. 3. For example, safety certified nets (302) around each light fixture (301) can be secured to lugs or other attachment points on the crown, safety certified cables can also be attached to each light fixture and likewise be secured to lugs or other attachment points on the crown, etc. so that nothing can drop off of or fall from the unit, i.e., it is constructed to meet or exceed all industry "Drops standards"—the drop program standard to build equipment ensuring things don't fall or get dropped from heights.

The scope of the claims should not be limited by the preferred embodiments set forth in description of the preferred embodiments or in the examples, but should be given the broadest interpretation consistent with the description as a whole.

The invention claimed is:

1. A method of providing lighting to a drilling rig site comprising, attaching at least one light fixture directly to the crown of a drilling rig on each of at least two sides of the crown, wherein the light fixture contains a fixed or removable light fixture attachment connecting the at least one light fixture to the crown, and wherein the drilling rig includes secondary containment.

2. The method of claim 1, wherein the light fixture and light fixture attachment comprise a single piece.

3. The method of claim 1, wherein the light fixture is fixed or adjustable.

4. The method of claim 1, wherein the light fixtures are attached around the perimeter of the crown.

5. The method of claim 1, wherein the light fixtures are attached to all sides of the crown.

6. The method of claim 1, comprising more than one light fixture attached to each side of the crown.

7. The method of claim 1, wherein said light fixture attachment holds more than one light fixture spaced vertically or horizontally from each other.

8. The method of claim 1, wherein each light fixture can swivel and/or tilt.

9. The method of claim 1, wherein the crown forms a generally rectangular shape.

10. The method of claim 1, wherein the lighting is provided to 180 degrees to 360 degrees around the drilling rig site.

11. A drilling rig including a derrick or mast and crown, having a drilling site lighting system attached thereto, comprising at least one light fixture attached directly to the crown on each of at least two sides, wherein the light fixture contains a fixed or removable light fixture attachment connecting the light fixture to the crown, and wherein the drilling rig includes secondary containment.

12. The drilling rig of claim 11, wherein the light fixture and light fixture attachment comprise a single piece.

13. The drilling rig of claim 11, wherein the light fixture is fixed or adjustable.

14. The drilling rig of claim 11, wherein the light fixtures are attached around the perimeter of the crown.

15. The drilling rig of claim 11, wherein the light fixtures are attached to all sides of the crown.

16. The drilling rig of claim 11, comprising more than one light fixture attached to two or more sides of the crown.

17. The drilling rig of claim 11, wherein said light fixture attachment holds more than one light fixture spaced vertically or horizontally from each other.

18. The drilling rig of claim 11, wherein each light fixture can swivel and/or tilt.

19. The drilling rig of claim 11, wherein the crown forms a generally rectangular shape.

20. The drilling rig of claim 11, wherein the lighting is provided to 180 degrees to 360 degrees around the drilling site.

* * * * *